United States Patent [19]

Rowe

[11] 4,196,023

[45] Apr. 1, 1980

[54] TREATING AUTOMOBILE BODIES

[75] Inventor: Arthur J. Rowe, Coulsdon, England

[73] Assignee: Carrier Drysys Limited, London, England

[21] Appl. No.: 862,722

[22] Filed: Dec. 20, 1977

Related U.S. Application Data

[63] Continuation-in-part of Ser. No. 807,666, Jun. 17, 1977, abandoned, which is a continuation-in-part of Ser. No. 561,987, Mar. 25, 1975, abandoned.

[30] Foreign Application Priority Data

Mar. 25, 1974 [GB] United Kingdom ..... 13183/74

[51] Int. Cl.[2] ..... C23F 7/10

[52] U.S. Cl. ..... 148/6.15 R; 118/304; 118/314; 118/315; 118/316; 118/324; 118/425; 148/6.15 Z; 204/181 R

[58] Field of Search ..... 427/424, 435, 427, 233; 148/6.15 R, 6.15 Z; 118/425, 314, 315, 316, 324, 304, 423; 204/181 R

[56] References Cited

U.S. PATENT DOCUMENTS

| | | | |
|---|---|---|---|
| 2,598,163 | 5/1952 | Halls | 427/435 |
| 2,598,201 | 5/1952 | Williams et al. | 118/304 |
| 3,477,870 | 11/1969 | Boretti et al. | 427/424 |
| 3,705,817 | 12/1972 | Dürr | 427/435 |
| 3,724,415 | 4/1973 | Knight | 427/424 |
| 3,839,888 | 10/1974 | Durr | 118/304 X |

FOREIGN PATENT DOCUMENTS 2149466 of 1973 Fed. Rep. of Germany ..... 148/6.15 R

OTHER PUBLICATIONS

Spring, Samuel, "Crystalline Phosphate Coatings for Steel", *Metal Finishing*, May 1965, pp. 61–62.

Sathyanandham et al., "A Critical Survey of Phosphating Processes", *Metal Finishing*, Aug. 1967, pp. 48–51.

*Primary Examiner*—Evan K. Lawrence

*Attorney, Agent, or Firm*—Diller, Ramik & Wight

[57] ABSTRACT

An automobile body is prepared for painting by suspending it roof uppermost from movable conveyor means and moving it first past spraying means which sprays the body at high energy with a phosphate solution so as to initiate a fine crystalline deposit growth on the exposed body panels. The body is then moved roof uppermost into and along a tank containing a flowing stream of phosphate solution, in which it is immersed to a level about that of the window openings. During this movement, a static head of phosphate solution is created in the body so as to generate a flow of the solution from the interior to the outside of the body by flooding the solution under pressure through the window openings. Crystalline deposit growth over the unimmersed upper portion of the body is sustained by spraying the upper portion with phosphate solution.

13 Claims, 2 Drawing Figures

TREATING AUTOMOBILE BODIES

This application is a continuation-in-part of application Ser. No. 807,666 filed June 17, 1977, abandoned, which is a continuation-in-part of my application Ser. No. 561,987 filed Mar. 25, 1975, abandoned.

BACKGROUND OF THE INVENTION

1. Field of the Invention

This invention relates to the treatment of automobile bodies preparatory for painting, particularly by an electro-deposition process.

2. Description of the Prior Art

One stage in the pre-treatment of automobile bodies is that of chemically treating the bodies with a phosphate solution prior to application of the first paint coat. This has hitherto been done by immersing the bodies in a tank containing the solution, or in some cases by spraying the phosphate solution on to the bodies.

The traditional phosphating process involves immersing the steel body to be treated into an aqueous solution of zinc or iron phosphate and free phosphoric acids together with an oxidising agent. When the body is immersed in the solution, the acid reacts with the metal, forming metal salts and hydrogen. The metal salts develop as a crystalline coating on the exposed body surfaces, which coating subsequently acts as a key for the first paint coat and at the same time provides the metal surface with certain corrosion-resisting properties.

The growth and characteristics of the crystalline coating depend on a number of criteria, such as the physical conditions of application of the solution, the chemical equilibrium of the phosphating bath, and the conditions of the metal surface itself.

As is well known, automobile bodies incorporate within their structure enclosed passageways or other hollow formations the interiors of which it is desired to treat in addition to the exterior body surfaces before the bodies are passed to the painting process, and neither immersion nor spraying are entirely satisfactory for achieving this. The spray method initiates the chemical action very well, but much of the internal metal is masked from the sprays and is thus ineffectively treated; when using the immersion method, initiation of the treatment is greatly retarded by the relative stagnancy of the phosphate solution in relation to the metal surface, particularly in enclosed and shielded parts internally of the body.

In addition, problems can arise after the phosphating treatment, when paint is applied by electro-deposition, which lead to a phenomena known as "scab corrosion" in the finished vehicle. This is body corrosion which results from an ineffective bonding between the crystalline phosphate coating and the metal surface, and is usually associated with too coarse a crystalline growth on the body with excessive and inconsistent weight deposition.

It has been found that when using electro-deposition paint priming processes, scab corrosion can be substantially reduced if a smaller or finer phosphate crystalline structure is obtained than that normally produced by conventional immersion techniques. For best results, it is desirable to obtain a compact crystalline multinuclear phosphate deposit having a surface density of between $10^5$ and $10^6$ crystals/cm$^2$ with a consistent weight of deposition of from 1.5 to 2.0 grams per square meter. This ensures that crystal loss which occurs during electro-deposition does not materially affect the efficiency of the phosphate film.

It is an object of the present invention to provide a method of preparing automobile bodies for painting which method results in a fine multi-nuclear crystalline phosphate coating with a substantially consistent weight of deposition thereby providing a suitable key for a first paint coat and substantially reducing the risk of scab corrosion in the finished vehicle.

SUMMARY

An automobile body is prepared for painting by a surface treatment which results in a primary coating comprising a very fine multi-nuclear crystalline phosphate structure having a uniform surface density of between $10^5$ and $10^6$ crystals/cm$^2$ and a substantially consistent weight of between 1.5 and 2.0 gm/m$^2$. The body is conveyed roof uppermost past high pressure sprays of phosphate solution which produce a maximum droplet size of between 100 and 250 microns and given an impact velocity on the body surfaces of at least 7.5 m/sec. These sprays initiate the growth of the fine crystalline structure from a multitude of crystal nuclei. The sprays are applied for a predetermined time, preferably in the region of 14 to 16 seconds. The growth of the crystalline structure is then completed by immediately immersing the body in a tank containing the phosphate solution generally to a level about that of the window openings. A flow of the solution is generated from one end of the tank to the other to cause the solution to move relative to the body during its movement through the tank. This achieves constant replenishment of solution and avoids contamination.

The unimmersed upper portion of the body is sprayed with the solution whilst the body moves along the tank and at the same time phosphate solution is flooded through the window openings so that a head of solution builds up inside the body to cause a flow of solution from the interior of the body to the outside. The process ensures that a fine, even crystalline coating is present on all exposed body panels.

DESCRIPTION OF THE PREFERRED EMBODIMENT

Figure 1:
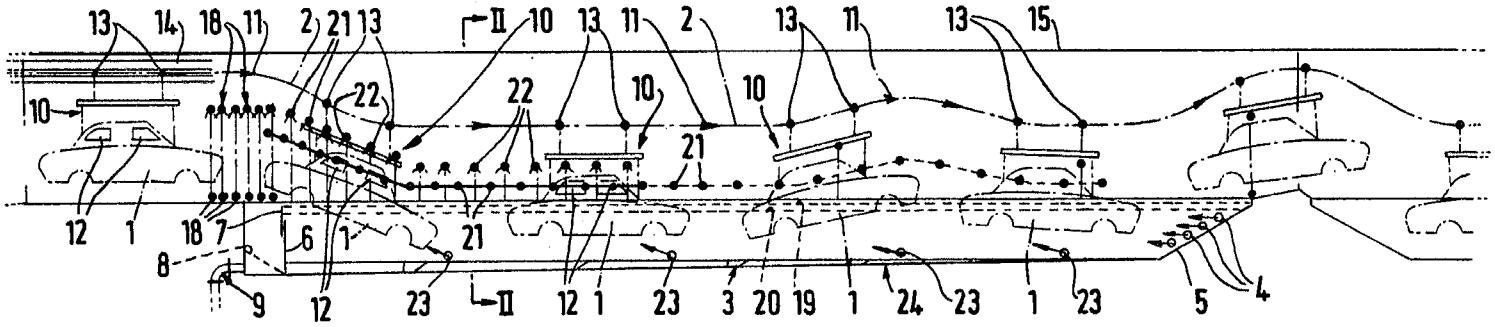
FIG. 1 diagrammatically illustrates apparatus according to the invention.

Referring to the drawings, automobile bodies 1 are moved by conveyor means 2 through cleansing tanks, consising of an alkali tank and a rinsing tank or tanks, not shown, and thence to the apparatus for applying a phosphate coating to the bodies. The apparatus comprises an open-topped tank 3 containing phosphate solution intended to produce a corrosion inhibiting and paint bonding crystalline phosphate coating on the metal body.

Generally, iron and zinc phosphates are used in aqueous solution at a pH of from 2 to 4 and at a concentration of between 10 and 38 points. (The concentration of zinc phosphate bath is generally expressed on a "point" scale. A point is equivalent to 1 ml of 0.1 normal NaOH and the concentration of the phosphate solution is expressed as the number of milliliters of 0.1 normal NaOH required to neutralise the total acid in a 10 ml sample with phenolpthalein as indicator. A typical concentration is between 10 and 38 points). A typical analysis of a 27-point solution would be zinc 0.24%, phosphate 1.0%, nickel 0.2%, nitrate 0.2% and fluoride 0.2%. A preferred phosphate solution is prepared from the product sold under the Trade Mark GRANODINE 38 TC at a pointage of between 13 and 15.

The chemical reactions involved in the production of the coating by the method according to the invention are substantially conventional. The reaction begins by action of the acid on the metal with the formation of a salt according to the following equation:

$$Fe+2H_3PO_4 \rightarrow Fe^{2+}+2H_2PO_{4-}+H_2$$

The pH rises due to the reduction in hydrogen ion concentration in the boundary layer and as a result, insoluble phosphates are precipitated.

Starting with a solution which contains primary zinc phosphate and free phosphoric acids, the following reaction may take place:

$$3Zn(H_2PO_4)_2+xH_3PO_2+(4+x)Fe \rightarrow Zn_3.(PO_4)_2+(4+x)Fe\ PO_4+3/2(4+x)H_2$$

Apart from tertiary zinc phosphate, ferric phosphate is also formed as an end product. The speed of the reaction may be accelerated by oxidation of the iron by oxidising agents such as nitrates, nitrites, chlorates and other compounds, the ferrous ions being oxidised into the insoluble ferric ions and precipitated as a sludge.

The tank is provided with header means 4 operable to cause the solution to flow from one end 5 of the tank to the opposite end 6, where it flows over an adjustable weir 7 and through a screen 8 to a return header 9 by which the solution is fed to a solution control unit, not shown, embodying filtration, heating, and titration. The solution is recycled from this control unit to the header means 4.

Figure 2:
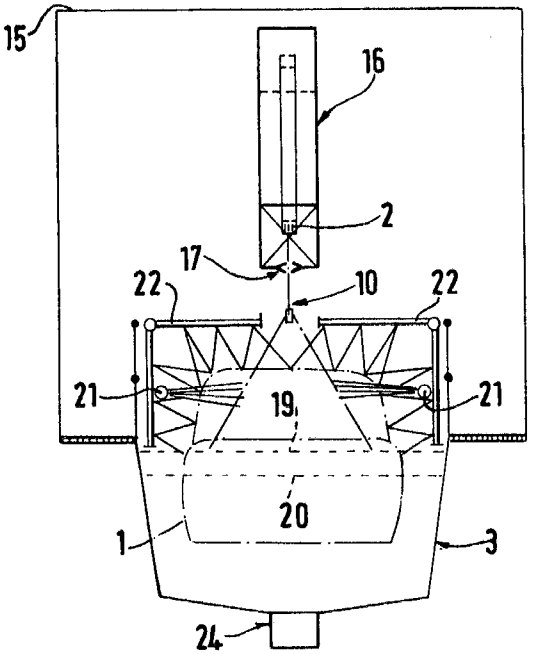
FIG. 2 is a diagrammatic section on line II—II, FIG. 1.

The conveyor means includes, for each body 1, a suspension device 10 which is connected at 13 to the conveyor 2 for movement therewith and which is arranged to support a body 1 roof uppermost for movement by the conveyor means lengthwise along the tank 3 in, as indicated by arrows 11, a direction opposite to the direction of flow of the phosphate solution through the tank. During movement of the body along the tank, the body 1 is partially immersed in the priming coating solution to a level about that of window openings 12 in the body. The conveyor 2 is movable along a guide track 14 which is so constructed, as illustrated in FIG. 1, as to cause a body 1 carried by a suspension device 10 to be alternately tipped fore and aft during the partial immersion of the body and movement thereof along the tank 3. The apparatus is housed in a ventilated enclosure 15 and the conveyor 2 and the guide track 14 are, in known manner, housed in a vapour-sealed duct 16, FIG. 2, to which heated air is supplied, the connections 13 for the suspension devices 10 extending through a nylon brush vapour seal 17.

Before a body 1 enters the tank 3 it passes between high-pressure means 18 which spray the body with phosphate solution. The pre-spray means 18 are capable of producing spray droplets with a maximum size of 100–250 microns which have an impact velocity on the body surfaces of at least 7.5 m/sec. The impact of these sprays on the outer surface of the body initiates the crystalline growth of the zinc phosphate coating. The use of high-pressure sprays ensures that the crystalline growth develops from a large number of active centres of crystallisation. This results on exposed body surfaces in a densely packed crystalline zinc phosphate coating having a uniform surface density of between $10^5$ and $10^6$ crystals/cm$^2$ and a coating weight of between 1.5 and 2.0 gm/m$^2$, values which substantially reduce the risk of scab corrosion in the finally painted vehicle.

High-energy sprays of this kind can be obtained for example by using a full cone nozzle operating at 10 to 30 p.s.i. liquid supply pressure.

The sprays are applied to the body for between 10 and 20 seconds and suitably between 14 and 16 seconds; the preferred time is 15 seconds.

As can be seen from FIG. 1, as the body leaves the pre-spray region it is moved, still roof uppermost, into and along the tank 3 in a direction opposite to that of the flow of the stream of priming coating solution in the tank, the body being partially immersed in the solution to a level about that of the window openings 12. The crystalline zinc phosphate coating builds up on the body as the body passes through the tank, and the rapid flow of phosphating liquid over the exposed body surfaces ensures that no surface exhaustion of the solution takes place.

In order to prevent exhaustion of solution within enclosed body sections (such as box sections) during the movement of the body along the tank, a static head of phosphate solution, indicated diagrammatically by a line 19, is created in the body measured against the normal level 20 of the stream of solution. This head causes a flow of solution from the interior of the body to the outside and is achieved by flooding phosphate solution under a pressure of about 40 p.s.i. into the interior of the body from flooding headers 21 through the window openings 12.

Crystalline deposit growth over the unimmersed upper portions of the body is sustained by post-spraying means 22 which are arranged alongside the tank 3 and which spray the upper portions of the body with the phosphate solution as the body moves along the tank. These post-spraying means 22 can be simple "wetting" sprays or alternatively they may be high-pressure sprays similar to sprays 18.

Flow-sustaining headers 23 extend across the tank 3 and are located at selected positions along the tank and inject into the tank phosphate solution which has a component of movement in the direction of flow of solution in the tank thereby to boost and maintain the flow against movement of the partially immersed body.

Sludge which falls to the bottom of the tank 3 is received in a sludge return header 24 by which it is delivered to tanks and clarifying devices of any suitable known kind (not shown).

By the use of the apparatus just described there is provided a method of preparing automobile bodies for painting which combines the advantage of the known methods of coating by spraying and coating by immersion, and which avoids the disadvantages of both. This is due to the arrangement whereby a body is subjected to prespraying to initiate a fine crystalline growth on the body, the creation of a head, as described above, in the body during movement along the tank, and to the spraying of the unimmersed portions of the body. Also of assistance is the continual addition of fresh priming coating solution and the overflow of solution from the tank so as to maintain the active condition of the solution substantially constant throughout the treating process. This latter feature can be further improved by the introduction of metered quantities of replenishing chemical agents for example through the flooding headers 19 and/or the flow-sustaining headers 23, and by recycling of clarified solution to the headers 2.

The head of solution in the interior of a body can be controlled by the use of plates which close selected portions of the interior of the body. These plates may be magnetically attached to the body.

It will be understood that the phosphate solution will be maintained at a temperature sufficient to the needs of the coating process, and in general this temperature will be in the range of 60° to 65° C.

As discussed above, it has been found that the pre-spraying effected by the spray means 18 encourages the production of active centres on the metal and ensures the subsequent compactness of the crystalline structure produced by the immersion and further spraying process. The growth of the crystalline structure is made possible in the immersion stage by the controlled equilibrium condition of the body surface obtained by maintaining a steady replenishment of priming coating solution as described above. The immersion levels are determined for the most vulnerable parts of the sheet metal body and the immersion conditions which apply to the exterior surfaces are simulated in the internal or substantially enclosed sections of the body by the flooding treatment in the interior of the body as described above.

The method of the invention enables between 30 and 100 bodies per hour to be treated using the apparatus described, preparatory to painting by electro-deposition or any other suitable method.

I claim:

1. The method of preparing an automobile body for painting by an electro-deposition process, which comprises the steps of:

(a) initiating the growth of a fine crystalline phosphate structure on the exterior exposed surfaces of the automobile body from a multitude of crystal nuclei by spraying said exterior exposed surfaces with a phosphate solution capable of chemically reacting with the surfaces of the body for a period of time sufficient to form said phosphate crystal nuclei, the spray having a maximum droplet size in the order of 100–250 microns and being effected at high energy so as to give an impact velocity on the exterior body surfaces of at least 7.5 m/sec;

(b) immediately immersing the body roof uppermost in a tank containing phosphate solution to a level about that of the bottom of the window openings and maintaining a flow of said solution relative to the exterior of the body for a time sufficient to complete the formation of said fine crystalline structure on the immersed exterior sections of the body to give a substantially uniform surface density for said fine crystalline structure of between $10^5$ and $10^6$ crystals/cm$^2$ and a coating weight of between 1.5 and 2.0 gm/m$^2$;

(c) creating in the interior of the body during immersion a static head of said phosphate solution measured against the normal level of the stream so as to cause a flow of solution from the interior of the body to the outside thereof by flooding solution under pressure into the interior of the body through the window openings; and (d) simultaneously spraying the unimmersed exterior upper portions of the body with said phosphate solution to complete the formation of said fine crystalline structure on the exterior upper portions of the body.

2. The method as claimed in claim 1, wherein the body is suspended roof uppermost from movable conveyor means, and a flowing stream of phosphate solution is created in said tank, and the pre-sprayed body is moved by said conveyor means roof uppermost along said tank in a direction opposite to the flow of said stream.

3. The method as claimed in claim 1, wherein the high energy spray operable to initiate the growth of the fine crystalline phosphate structure on exposed surfaces of the automobile body comprises one or more full cone nozzles operating at a pressure in the order of 10 to 30 p.s.i. and adjusted to produce a maximum droplet size of 100–250 microns.

4. The method as claimed in claim 1, wherein the period of time for which the exposed body surfaces are sprayed is in the order of 10 to 20 seconds.

5. The method as claimed in claim 4, in which said period of time is 15 seconds.

6. The method as claimed in claim 2, in which the body is alternately tipped fore and aft during the partial immersion of the body in the stream and movement thereof along the tank.

7. The method as claimed in claim 1 including the step of maintaining the direction of flow of the stream against movement of the body by injecting into the stream at selected positions along the length thereof additional phosphate solution having a component of movement in the direction of flow of the stream.

8. The method as claimed in claim 1 in which the flooding phosphate solution is introduced into the body at a pressure of about 40 pounds per square inch.

9. The method as claimed in claim 1, including the step of continually monitoring and replenishing the phosphate solution in the tank so as to maintain the active condition of the solution substantially constant throughout the coating process.

10. The method as claimed in claim 1, wherein the phosphate solution is a zinc or iron phosphate solution.

11. The method of preparing an automobile body for painting by an electro-deposition process, which comprises the steps of:

(a) providing an automobile body having window openings and interior structure which communicates exteriorally of the body at the bottom thereof below said window openings;

(b) subjecting exterior surfaces of the body to high energy spray of phosphate solution for a time sufficient to initiate the growth of a fine crystalline structure thereon which has a surface density of between $10^5$ and $10^6$ crystals/cm$^2$, the spray having a maximum droplet size in the order of 100–250 microns and being effected to give an impact velocity of said droplets on the surface of at least 7.5 m/sec;

(c) immediately immersing the body roof uppermost in phosphate solution up to a level below but about that of the window openings and maintaining flow of said solution relative to the body for a time sufficient to complete the growth of said fine crystalline structure with a coating weight of between 1.5 and 2.0 gm/m$^2$;

(d) during step (c):

(i) creating a static head within said body by flooding said solution into the interior thereof whereby to effect flow of solution from the interior of said body through said interior structure; and (ii) spraying the unimmersed upper portions of said body with said phosphate solution; and (e) recovering the prepared body from said immersion, flooding and spraying thereof.

12. The method as defined in claim 11 wherein said phosphate solution contains primary zinc phosphate and phosphoric acid.

13. The method as claimed in claim 1 wherein the period of time for which the exposed body surfaces are sprayed is between 14 and 16 seconds.

* * * * *